US006928753B2

(12) United States Patent
Richter et al.

(10) Patent No.: US 6,928,753 B2
(45) Date of Patent: Aug. 16, 2005

(54) DEVICE FOR KEEPING A COLD-ROLLED STRIP DRY IN THE OUTLET OF STRIP ROLLING MILLS

(75) Inventors: Hans-Peter Richter, Friedewald (DE); Armin Klapdor, Kirchhundem (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/504,620

(22) PCT Filed: Jan. 31, 2003

(86) PCT No.: PCT/EP03/00958

§ 371 (c)(1),
(2), (4) Date: Aug. 13, 2004

(87) PCT Pub. No.: WO03/068426

PCT Pub. Date: Aug. 21, 2003

(65) Prior Publication Data

US 2005/0102855 A1 May 19, 2005

(30) Foreign Application Priority Data

Feb. 15, 2002 (DE) ..... 102 06 244

(51) Int. Cl.[7] ..... F26B 13/06
(52) U.S. Cl. ..... 34/620; 34/634; 34/638; 34/641; 34/643; 72/39
(58) Field of Search ..... 34/611, 614, 618, 34/620, 623, 634, 638, 641, 643, 651; 72/38, 72/201

(56) References Cited

U.S. PATENT DOCUMENTS 2,460,571 A * 2/1949 Chaffee ..... 162/157.6
4,694,899 A * 9/1987 Wood et al. ..... 164/452

(Continued)

FOREIGN PATENT DOCUMENTS

DE 4305907 8/1994
DE 195 19 544 A1 11/1996

(Continued)

OTHER PUBLICATIONS

Patent Abstracts of Japan, vol. 1995, No. 10, Nov. 30, 1995 & JP 07 178438 A (Niigata Uoshinton KK), Jul. 18, 1995.

*Primary Examiner*—Stephen Gravini
(74) *Attorney, Agent, or Firm*—Friedrich Kueffner

(57) ABSTRACT

The preferred quality requirements postulated by producers for the product cold-rolled strip include, among good flatness and optimum thickness tolerances, also dryness of the strip in the outlet of strip rolling mills. Already existing devices that are disposed in the outlet of roll stands comprise stationarily installed and mobile partitions, a roll barrel and a roll strip venting device and a vapor escape. The aim of the invention is improve the aforementioned device by disposing above the rolled strip (10) a strip deflector (3) with an integrated fan-operated strip venting device (4) by means of a low-pressure nozzle (7) and an upper roll barrel gap seal (5) in the form of a slotted nozzle (6) and below the rolled strip (10) an extraction device (16) with integrated lower strip deflector (17).

7 Claims, 3 Drawing Sheets

U.S. PATENT DOCUMENTS 5,775,152 A * 7/1998 Daub et al. ..... 72/39
6,134,811 A 10/2000 Berger et al.
6,834,521 B1 * 12/2004 Denker et al. ..... 72/39

FOREIGN PATENT DOCUMENTS

EP 0765695 4/1997

* cited by examiner

DEVICE FOR KEEPING A COLD-ROLLED STRIP DRY IN THE OUTLET OF STRIP ROLLING MILLS

The invention concerns a device for keeping cold-rolled strip dry in the outlet of strip rolling mills with means for deflecting liquid rolling media in the area of the strip outlet and/or for keeping away liquid spraying onto the surfaces of the strip, wherein these means, which may, for example, be combined into a functional unit, comprise permanently installed partitions and movable partitions located above and below the rolled strip, a roll barrel blowing device, a roll barrel gap seal, and a vapor exhaust system.

The most desirable quality requirements of producers of the product "cold-rolled strip" include, besides good flatness and optimum thickness tolerances, dryness of the strip in the outlet of cold-rolling mills and strip mills in order to avoid surface defects, such as spots, in the further processing of the strip.

In the state of the art, different devices and measures are known which have the goal of obtaining dry strip that is free of moisture and rolling media. To this end, blowing systems, partitions, exhaust systems and combinations of these devices and measures are used in various cases.

For example, DE 44 22 422 A1 describes a device for contact-free sealing of the gap between a partition and a work roll in the outlet of a rolling stand, and a partitioning element with a slotted nozzle is arranged approximately tangentially to the surface of the work roll at a relatively short distance from it and from the rolled strip. On its front face, the partitioning element has an end part that tapers like a blade, is arranged approximately tangentially to the surface of the roll and a short distance from it, and is arranged and designed in such a way that an injector-like flow channel that steadily expands in cross section is formed between it and the surface of the roll.

Previously known devices and measures for producing dry strip are energy-intensive, complicated, and cumbersome during both roll changes and adjustment of the roll gap, and create a disturbing noise level.

In some cases, sufficient removal of the unwanted moisture from the surface of the strip and thus a dry cold-rolled strip that satisfies requirements were not achieved, because insufficient attention was paid to the reasons for the deposition and/or the entrainment of moisture on the surface of the strip. These reasons include the following:

- rolling medium is entrained by the rolls and thrown onto the strip as it runs out;
- rolling medium sprays beside the edge of the strip through the roll gap and in this way gets back onto the strip; and
- vapor in the outlet area of the mill condenses and drips onto the strip.

To obtain cold-rolled strip that is truly free of interfering moisture, EP 0 765 696 B1 proposes a combination of various means for deflecting and removing liquid rolling medium. In this method, a stationary partition, which has one part installed above the strip flow as far as the stand platform and another part installed below the strip flow as far as the base plate, partitions the moist/wet roll area from the finish-rolled strip. An additional, movable partition that consists of moving parts provides more complete partitioning of the moist/wet roll area from the finish-rolled strip, but at the same time, due to the mobility of the parts, it allows an advantageous accessibility of the rolls, for example, when a roll change is being carried out. At the same time, these movable parts realize the function of a strip deflector and/or a means for strip transfer. The moving parts, which are designed as stops, can be optionally adjusted to be mechanically stationary or adjusted as a function of roll barrel wear.

Other installed components are:

- a roll barrel blowing device for preventing rolling medium that has been squeezed off from being transferred to the finish-rolled strip,
- a roll barrel gap seal, which seals the moist/wet roll space above the rolled strip from the finish-rolled strip,
- a strip edge blowing device, by which the entrained rolling oil at the side of the strip edge is carried away to the side from the rolled strip, and
- a vapor exhaust system in the strip channel with parallel airflow in the direction opposite the direction of strip flow above and below the rolled strip.

The objective of the invention is to further develop the device for keeping cold-rolled strip dry that is described in EP 0 765 696 B1 and referred to as a DS (dry strip) system to ensure that the rolled strip leaves this "DS system" drip-free and that only a residual amount of oil, which is determined by the emulsion composition and the rolling process, still remains on the rolled strip.

In regard to a device of a rolling stand of the specified type for keeping cold-rolled strip dry, which is installed above and below the strip flow between the housing uprights and has the characterizing features of claim 1, this objective is achieved by

- an upper strip deflector arranged above the rolled strip with integrated fan-driven blowing by means of a low-pressure nozzle and with an upper roll barrel gap seal in the form of a slotted nozzle, and
- a separate exhaust device arranged below the rolled strip with an integrated lower strip deflector.

Advantageous modifications of the invention are specified in the dependent claims.

With the system parts specified in claim 1, the device consists all together, in the area of the strip outlet, of the following system parts that work together:

- stationary partition above and below the rolled strip;
- upper strip blowing system with fan-driven low-pressure nozzle;
- upper roll barrel blowing system;
- upper roll barrel seal;
- upper strip deflector with adjustment mechanism for holding the blowing nozzle arranged above the rolled strip and for supplementing the upper partition; and
- strip channel with separate exhaust system below the rolled strip and an integrated lower strip deflector.

The interaction of these individual components successfully prevents the rolled strip from being recontaminated with rolling oil or emulsion after leaving the rolling gap. Rolling oil or emulsion escaping to the side of the rolled strip through the roll gap is carried off to the side in a well-defined way and removed from the outlet area by the lower exhaust system. This ensures that the upper and lower sides of the rolled strip leave the outlet area drip-free and that only a residual amount of oil, which is determined by the emulsion composition and the rolling process, still remains on the rolled strip.

In detail, the following effects are achieved by the individual components:

- the stationary stand partition, which is installed above the rolled strip as far as the stand platform and below the rolled strip as far as the base plate, partitions the wet roller area from the finish-rolled strip;
- the upper strip blowing system with a fan-driven low-pressure nozzle carries the emulsion escaping next to the rolled strip through the roll gap to the side;

the upper roll barrel blowing system prevents squeezed-off emulsion from running down on the roll and getting onto the finished strip. The squeezed-off emulsion is carried away to the side by the airflow;

the upper roll barrel seal in the form of a slotted nozzle that exploits the Coanda effect, by which the air jet emerging from the orifice of the slotted nozzle follows the curved surface of the roll and thus produces, in the front area of the strip deflector, contact-free sealing of the area above the strip deflector from the roll and thus from the finish-rolled strip;

the upper strip deflector is designed to be moved at an angle of 20° to 45° and is arranged in such a way that the roll change can be made without any difficulty;

the strip channel that is formed with a separate exhaust system below the strip flow produces a well-defined flow around the edge of the strip after the roll gap. The exhaust system can be fan-driven from a suction tank installed below the strip, or exhausting can be accomplished with the aid of injector nozzles, which are installed below the strip flow in a strip guide table in such a way that they can be turned on in zones. The strip channel is formed in such a way that is can also be used as a threading aid for the leading end of the strip.

Although optimum utilization of the components described above is achieved only when they work together functionally, they can also be successfully used as individual components, especially in rolling mills that are already in operation.

Other details, advantages and features of the invention are explained in greater detail below with reference to the embodiments illustrated in the schematic drawings.

FIG. 1 shows a vertical partial section of a device for keeping cold-rolled strip dry.

FIG. 1*a* shows an enlarged view of the roll barrel gap seal from FIG. 1.

Figure 1:
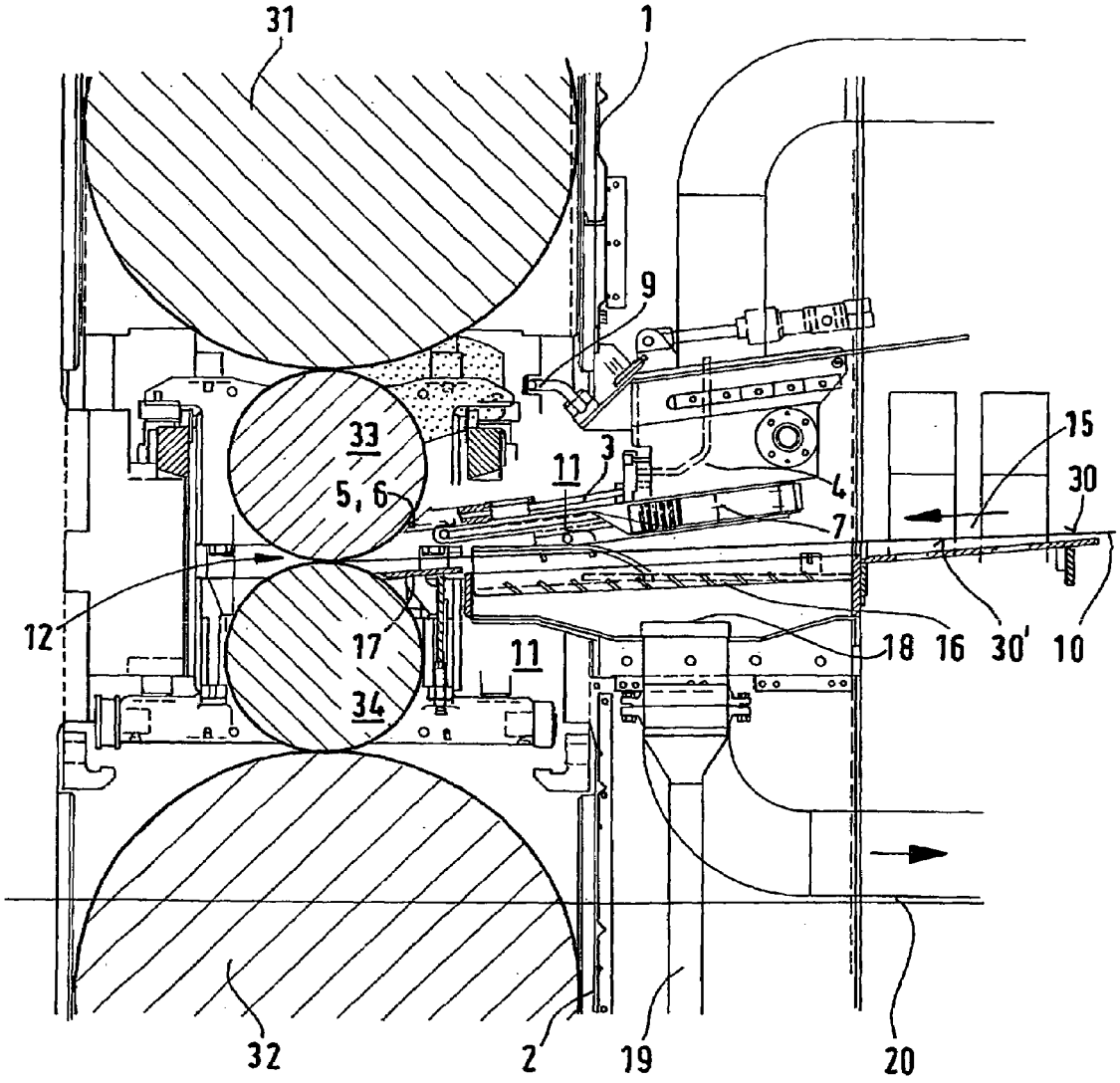

FIG. 1, in which the actual rolling stand is not included in the drawing, shows two backup rolls 31, 32. Two work rolls 33, 34 with an adjustable roll gap 12 are positioned between the backup rolls. Above and below the rolled strip 10 running out of the rolling stand (from left to right in the drawing), there is a moist/wet rolling zone 11, which is formed by the rolls 31, 32, 33, 34 and the rolled strip 10 and from which the rolled strip 10 that has run out is to be shielded.

To this end, first, this moist/wet rolling zone 11 is already partially partitioned from the finish-rolled strip 10 by a stationary upper partition 1 and a stationary lower partition 2. These stationary partitions 1, 2 are supplemented by movable partitions.

Figure 1A:
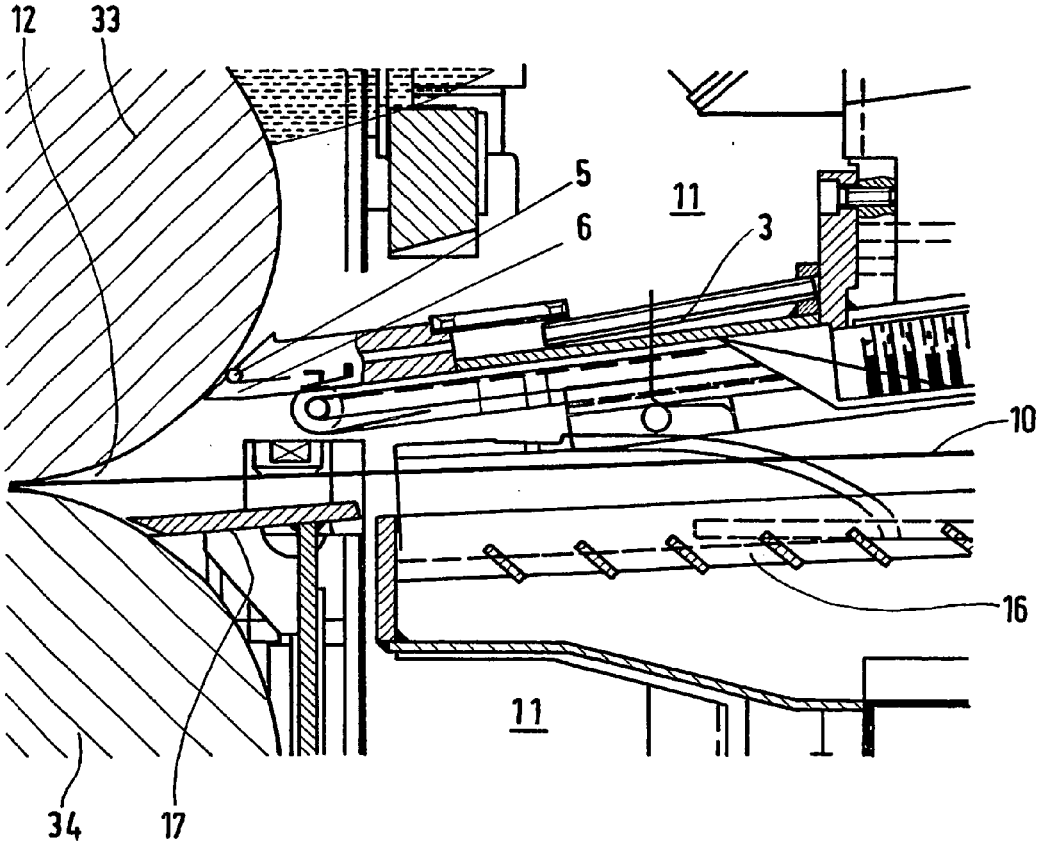

Above the rolled strip 10, this supplementary device consists of an upper, movably designed strip deflector 3, which contains an integrated fan-driven strip blowing device 4 with a low-pressure nozzle 7. This strip blowing device 4 is lengthened in the direction of the upper work roll 33 by a slotted nozzle 6 to form a roll barrel gap seal 5 and extends to a point very close to the work roll 33. Due to the special design of the slotted nozzle 6, the remaining gap between the work roll and the slotted nozzle 6 is sealed by utilizing the "Coanda effect". In accordance with the Coanda effect, the air jet emerging from the slotted nozzle 6 follows the contour of the curved surface of the work roll 33 positioned directly in front of the slotted nozzle 6 and thus pushes back the liquid media adhering to the surface of the roll. The enlarged drawing in FIG. 1*a* in particular clearly shows this slotted nozzle 6 of the roll barrel gap seal 5.

In addition to the slotted nozzle 6 (for work roll blowing) and the low-pressure nozzle 7 (for strip blowing), a roll barrel blowing device 9 is installed in the upper area of the work roll 33, by which liquid media still adhering to the work roll is driven off in the direction of rotation of the work roll 33 and thus away from the rolled strip 10.

To supplement the stationary lower partition 2, an exhaust device 16 is installed below the rolled strip 10, whose forward end is lengthened by a lower strip deflector 17 that extends as far as the lower work roll 34. The exhaust device is designed in such a way that, together with the upper strip deflector 3, it forms a strip channel 15, through which the rolled strip 10 is guided and which can also be used as a threading aid for the leading end of the rolled strip. The exhaust device 16 includes a suction tank 18 with a connected emulsion drain line 19 and an exhaust air line 20.

Figure 2:
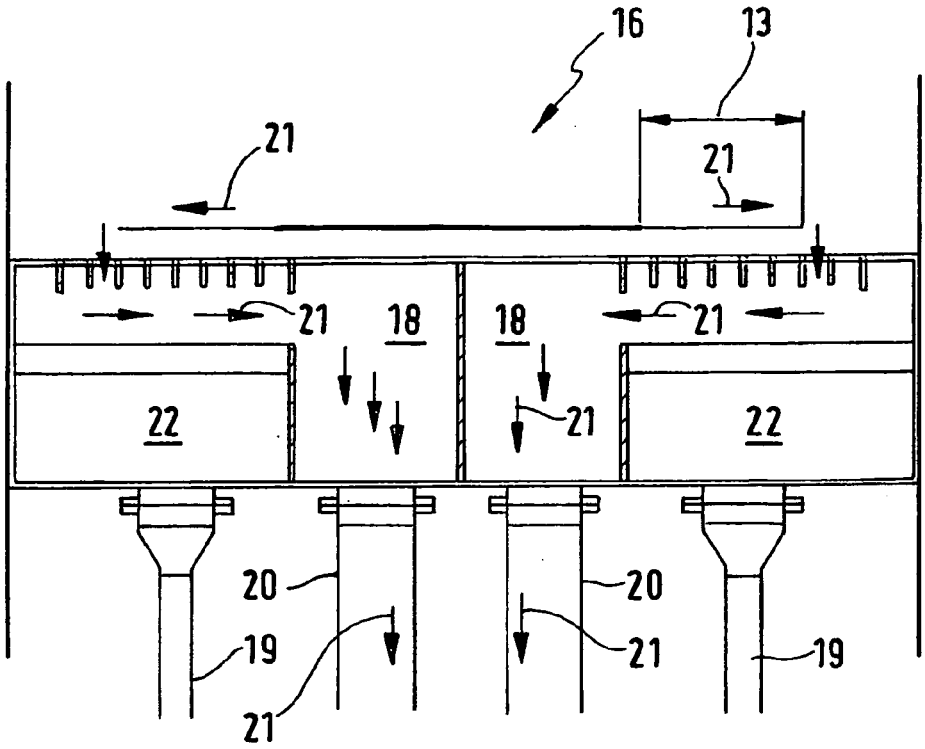
FIG. 2 shows a vertical section of airflow paths of the exhaust air in an exhaust device.

FIG. 2 shows a vertical section of the exhaust device 16 with the resulting directions of airflow 21. Air overpressure prevails above the rolled strip 10, while the air exhaust produces a partial vacuum below the rolled strip. Above the rolled strip 10, the resulting airflow paths 21 run parallel to the rolled strip to the edge of the rolled strip and then down along the edge into the suction tank 18, where the air is deflected towards the middle of the suction tank 18. The air is then further conducted into the exhaust air lines 20, by which the exhaust air is removed from the system. The deflection of the airflow from vertically downward (at the edge of the rolled strip) to horizontal (towards the middle of the suction tank) causes centrifugal separation of the droplets of emulsion or rolling oil, which are then collected in the separation chamber 22, from which they are removed through the emulsion drain line 19. In FIG. 2, the rolled strip edge region 13, which is important for keeping the cold-rolled strip dry, is shown especially prominently.

Figure 3:
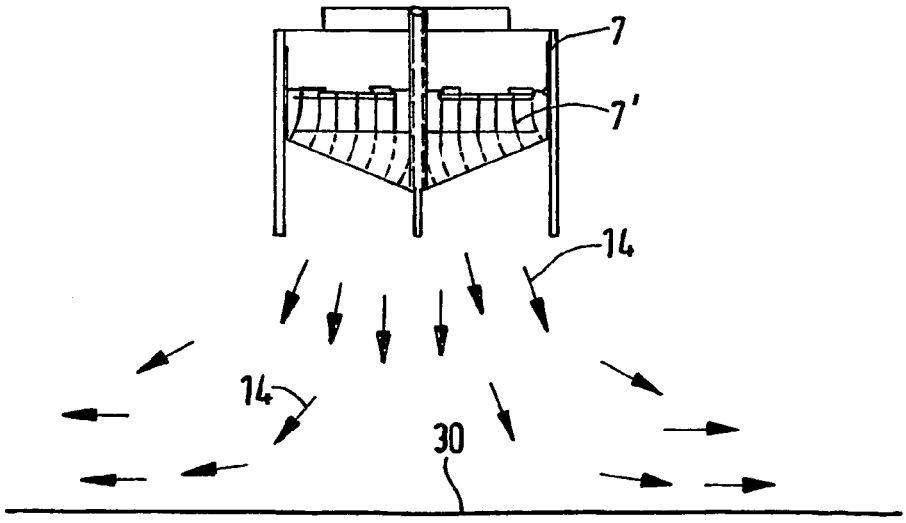
FIG. 3 shows a top view of airflow paths after a low-pressure nozzle.

FIG. 3 shows the directions of airflow 14 of the fan-driven strip blowing device 4. The air leaves the low-pressure nozzle 7 broadly fanned out in the opposite direction from the running direction of the rolled strip and is then distributed symmetrically over the entire upper surface 30 of the rolled strip towards the edges of the strip due to the plates 7' of the low-pressure nozzle 7. The rolling oil emerging from the roll gap 12 with the rolled strip 10 is reliably forced to the side towards the edges of the strip in this way, from which it is conveyed downward into the suction tank 18 by the air of the exhaust device 16 flowing around the edges of the strip.

It is apparent that the essential feature of the invention is the combination of all of the indicated structural elements of the device for keeping cold-rolled strip dry and their function in the new DS system. The device preferably can work together with a roll gap lubrication system that operates as a function of strip width and, in particular, independently of axially displaceable or stationary rolls.

The invention is not limited to the illustrated embodiment. Depending on requirements, individual components and their combination with one another can be varied. In addition, however, the device should be designed in such a way that it reliably prevents moisture in the form of drops or vapor condensation from falling back onto the rolled strip 10 and thus optimizes the quality of the strip. It is crucial to maintain the design in accordance with the invention, and the forced airflows of the upper strip blowing device 4 and of the lower exhaust device 16, as well as the overall interaction of the specified structural elements are also crucial.

LIST OF REFERENCE NUMBERS

1, 2 stationary partitions
3 upper strip deflector
4 strip blowing device
5 upper roll barrel gap seal
6 slotted nozzle
7 low-pressure nozzle
7' plates
9 roll barrel blowing device
10 rolled strip
11 upper and lower rolling zone
12 roll gap
13 rolled strip edge region
14 airflow direction of 7
15 strip channel
16 lower exhaust device
17 lower strip deflector
18 suction tank
19 emulsion drain line
20 exhaust air line
21 airflow direction of 16
22 separation chamber (for emulsion/rolling oil)
30, 30' surface of the rolled strip
31, 32 backup rolls
33, 34 work rolls

What is claimed is:

1. Device for keeping cold-rolled strip dry in the outlet of strip rolling mills with means for deflecting liquid rolling media in the area of the strip outlet and/or for keeping away liquid spraying onto the surfaces (30, 30') of the strip, wherein these means, which may be combined into a functional unit, comprise permanently installed partitions (1, 2) and movable partitions located above and below the rolled strip (10), a roll barrel blowing device, a roll barrel gap seal and a vapor exhaust system, wherein (a) an upper strip deflector (3) arranged above the rolled strip (10) with integrated fan-driven strip blowing (4) by means of a low-pressure nozzle (7) and with an upper roll barrel gap seal (5) in the form of a slotted nozzle (6), and (b) a separate exhaust device (16) arranged below the rolled strip (10) with an integrated lower strip deflector (17).

2. Device in accordance with claim 1, wherein the slotted nozzle (6) is designed in such a way that the seals the upper rolling zone (11) from the rolled strip (10) by exploiting the Coanda effect (flow of a gas jet along a curved surface in front of a gas discharge orifice).

3. Device in accordance with claim 1, wherein the upper strip deflector (3) can be moved and is oriented at an angle of 20° to 45° to the rolled strip (10).

4. Device in accordance with claim 1, wherein the exhaust device (16) is designed in such a way that the suction produces a well-defined flow around the edge of the strip after the roll gap.

5. Device in accordance with claim 4, wherein the exhaust system is fan-driven through a suction tank (18) installed below the rolled strip (10).

6. Device in accordance with claim 4, wherein the exhausting is accomplished with the aid of injector nozzles, which are installed below the rolled strip (10) in a strip guide table in such a way that they can be turned on in zones.

7. Device in accordance with claim 1, wherein the upper strip deflector (3) and the lower exhaust device (16) form a strip channel (15), through which the rolled strip (10) is guided after it emerges from the roll gap (12) and which is designed in such a way that is serves as a threading aid for the leading end of the strip.

* * * * *